US006076307A

United States Patent [19]

Kean

[11] Patent Number: 6,076,307

[45] Date of Patent: Jun. 20, 2000

[54] GUTTERING CLEANING SYSTEM

[75] Inventor: Anthony Frederick Kean, Vermont, Australia

[73] Assignee: Spoutmate PTY LTD, Greensborough, Australia

[21] Appl. No.: 08/244,398

[22] PCT Filed: Nov. 27, 1992

[86] PCT No.: PCT/AU92/00636

§ 371 Date: May 20, 1994

§ 102(e) Date: May 20, 1994

[87] PCT Pub. No.: WO93/11325

PCT Pub. Date: Jun. 10, 1993

[30] Foreign Application Priority Data

Nov. 29, 1991 [AU] Australia ..... PK9772
Feb. 20, 1992 [AU] Australia ..... PL1001

[51] Int. Cl.[7] ..... E04D 13/076

[52] U.S. Cl. ..... 52/11; 52/12; 52/16; 239/532; 239/208; 294/19.1; 134/166 R

[58] Field of Search ..... 52/11, 12, 16; 239/532, 208, 209; 294/19.1; 134/166 R, 201

[56] References Cited

U.S. PATENT DOCUMENTS

| | | | |
|---|---|---|---|
| 1,936,732 | 11/1933 | Renard | 239/209 X |
| 2,302,299 | 11/1942 | Court | 134/167 R |
| 2,624,299 | 6/1953 | Beegle | 52/16 |
| 2,710,616 | 6/1955 | Tydings . | |
| 2,865,674 | 12/1958 | Jelmeland | 239/208 |
| 2,887,073 | 5/1959 | Thompson | 52/16 |
| 3,023,971 | 3/1962 | Milhous . | |
| 3,041,655 | 7/1962 | Entler | 249/19.1 X |
| 4,028,895 | 6/1977 | Franzmeier | 52/16 X |
| 4,183,368 | 1/1980 | Husted | 52/16 X |
| 4,502,806 | 3/1985 | Albertson . | |
| 4,523,875 | 6/1985 | DiFiore | 52/12 X |
| 4,972,863 | 11/1990 | Morrow | 134/166 R |
| 5,119,849 | 6/1992 | Hinkley | 52/11 X |
| 5,386,942 | 2/1995 | Dietle | 239/532 |

FOREIGN PATENT DOCUMENTS

| | | | |
|---|---|---|---|
| 74372/91 | 10/1991 | Australia . | |
| 2573114 | 5/1986 | France . | |
| 2677065 | 12/1992 | France | 52/11 |
| 94/022603 | 10/1994 | WIPO | 134/166 R |

*Primary Examiner*—Carl D. Friedman
*Assistant Examiner*—Laura A. Saladino
*Attorney, Agent, or Firm*—Peterson, Wicks, Nemer & Kamrath, P.A.

[57] ABSTRACT

A guttering cleaning system for cleaning of spouting and guttering in building structures includes water outlets (15) mounted to rain water guttering (12) to direct water into the guttering to flusb debris. An outlet connector (21) is provided for each water outlet (15). A supply connector (22) for releasable connection to any one of the outlet connectors (21) supplies water to the outlet connectors (21). A water supply line (25) and a connector support (45) enables remote connection and disconnection of the supply connector (22) from the ground adjacent the building, the connector support (45) comprising a support pole (46) provided with the supply connector (22) at its upper end, the supply line (25) extending up the support pole (46) to the supply connector (22). The system further includes a connection release means (50) enabling selective release of the connection between the supply connector (22) and an associated outlet connector (21).

24 Claims, 2 Drawing Sheets

GUTTERING CLEANING SYSTEM

Figure 1:
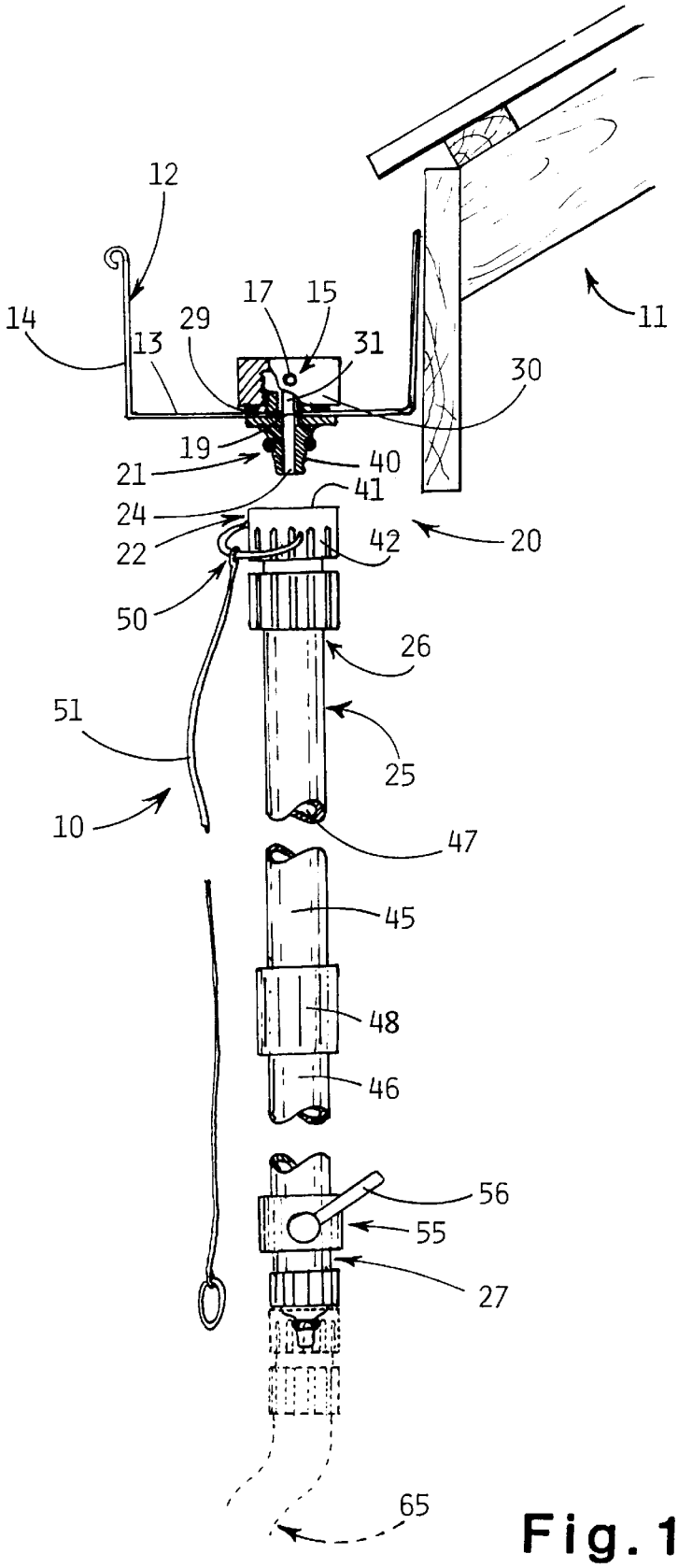

This invention relates to cleaning of spouting and guttering in building structures.

A continual problem with systems provided in buildings for collecting and conveying rain water to storm water drains is the necessity to keep the spouting and guttering clear of obstructions. For example, leaves and other debris gather in the guttering and can cause blockages of the guttering and downpipes and this can lead to overflowing. Also such debris can be inflammable and in this can provide a ready source of fuel during fires, particularly facilitating ignition during bush fires or forest fires.

Methods used in the past to deal with these problems included periodic manual cleaning, and provision of porous netting or mesh over the top of the guttering so that the leaves and the like can blow off the mesh while at the same time the water running off the roof can pass through the mesh into the guttering. Another procedure is to take a garden hose up a ladder and direct a jet of water along the guttering to flush the debris.

It is an object of the present invention to provide a guttering cleaning system which is effective to clear debris from guttering in buildings.

It is a further and preferred object of the present invention to provide a guttering cleaning system which is relatively simple to use.

It is a further and preferred object to provide a guttering cleaning system which can be operated from the ground.

The guttering cleaning system according to the present invention is for cleaning of spouting and guttering in building structures, and the system includes: a plurality of water outlets for mounting to or adjacent rain water guttering of a building, the water outlets being arranged in use to direct water into the guttering to flush debris that has gathered in the guttering; a releasable water connection comprising a plurality of outlet connectors, one outlet connector being provided for each of the water outlets and each outlet connector being operative to convey water to the respective associated water outlet, the releasable water connection also comprising a supply connector for releasable connection to any one of the outlet connectors so as to supply water from a water supply to the outlet connectors and to enable disconnection of the water supply from the outlet connectors, each outlet connector being mounted and remaining in place on or adjacent the guttering and in communication with the respective water outlet; and a water supply line having two ends, one end of the supply line being provided at the supply connector, the other end of the water supply line being arranged to be connected in use to the water supply so that the water can be supplied through the supply line to the supply connector and in use through the outlet connector to which the supply connector is connected and thence to the respective water outlet so as to flush debris in the guttering, the supply connector being capable of being released and disconnected from the associated outlet connector and moved to another outlet connector when flushing of the guttering at one location has been completed.

Each water outlet preferably comprises a water nozzle for directing a jet or spray of water into the guttering, each nozzle being provided by a connector block having a passage extending from the associated outlet connector to the nozzle through which water passes from the outlet connector to the nozzle. Some of the connector blocks may be provided with more than one nozzle arranged to direct water in respective different directions into the associated guttering. Each connector block may be arranged to be mounted in a base wall of the guttering along which rain water flows in use, each connector block having a profile designed to minimize obstruction to flow of rain water past the connector block. In use of the system, a hole may be provided in a base wall of the guttering for each of the connector blocks, the connector block being arranged to be mounted inside of the guttering to the base wall and the associated connector being arranged to be mounted beneath the base wall of the guttering at the respective hole so that in use water can pass through the outlet connector through the hole in the base wall of the guttering and into the connector block and thence to the nozzle. In this construction, association with each hole may be provided in the base wall of the guttering, the sealing ring preventing leakage of water from the guttering through the hole where the mounting block and outlet connector is provided.

The system may further include a connector support for enabling remote connection and disconnection of the supply connector from the ground adjacent the building, the connector support comprising a support pole provided with the supply connector and its upper end, the supply line extending up the support pole to the supply connector, the system further including a connection release means enabling selective release of the connection between the supply connector and an associated outlet connector. In this arrangement, the support pole may comprise a hollow tubular pole, the supply line comprising a bore provided by the tubular pole so that water can enter the support pole at its lower end and travel upwardly through the bore in the tubular pole to the supply connector provided at the upper end. The connection release means may comprise a release cord extending along the length of the support pole and coupled to the supply connector, pulling of the release cord by a user causing release of the connection between the supply connector and the respective associated outlet connector, the connection of the supply connector to a selected one of the outlet connectors being achieved by raising the support pole to cause the supply connector to form a snap fit connection with the selected one of the outlet connectors.

The system preferably further includes a water control valve which is selectively operable by the user to disconnect the water supply as desired, the water control valve being provided at the end of the supply line remote from the supply connector, whereby the user can disconnect water supply when connecting the supply connector to a selected one of the outlet connectors, and can then connect the water supply by opening the valve to cause flushing of the guttering, and can then disconnect the supply of water by closing the valve prior to disconnecting the supply connector from the outlet connector at the end of the flushing operation.

The present invention also provides a Buttering cleaning system installed in a building structure having spouting and guttering for collecting and conveying rain water from the building structure, the guttering cleaning system being constructed as described above and installed with the water outlets being mounted to or adjacent rain water guttering of the building, the water outlets being arranged to direct water into the guttering to flush debris that has gathered in the guttering.

In the installed guttering cleaning system each water outlet comprises a water nozzle arranged so as to direct a jet or spray of water into the guttering in a direction along the guttering towards an associated discharge downpipe provided for conveying water from the guttering.

In one possible arrangement of the installed guttering cleaning system the guttering is provided with a hole in the base wall and the connector blocks are mounted inside of the guttering to the base wall and the associated connectors are mounted beneath the base wall of the guttering at the respective holes so that water passes through the outlet connectors through the holes in the base wall of the guttering and into the connector blocks and thence to the nozzles. In addition or alternatively to connector blocks being mounted to the base wall of the guttering, at least one of the water outlets may be mounted adjacent the top edge of an outside wall of the guttering and the associated outlet connector is accessible from below and outside of the outside wall of the guttering, the water outlet being directed along the guttering so as to direct water along the guttering from the top edge of the outside wall. Furthermore, at least one of the water outlets may be mounted to the guttering and arranged to direct water downwardly into the mouth of the downpipe provided for conveying water downwardly from the base wall of the guttering, the water from the water outlet thereby assisting flushing of debris that can gather around the mouth of the downpipe and to direct water with some force through the downpipe to help to dislodge any obstructions in the downpipe.

There may be provided a screen within a downpipe which conveys water downwardly from the guttering, the downpipe also including an access hatch located in a wall of the downpipe immediately above the screen and which is normally covered by a removable hatch cover, the screen operating to trap debris travelling down the downpipe while allowing water to pass through and the hatch cover being removable to enable a user to clear debris trapped by the screen.

Figure 2:
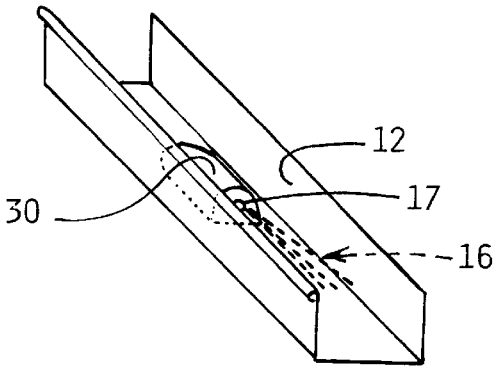
Figure 3:
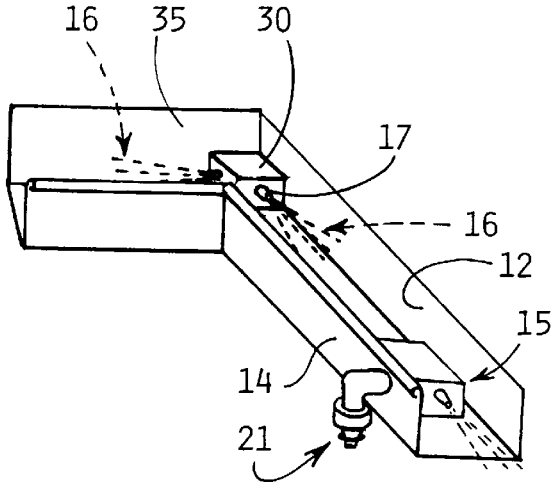
Figure 4:
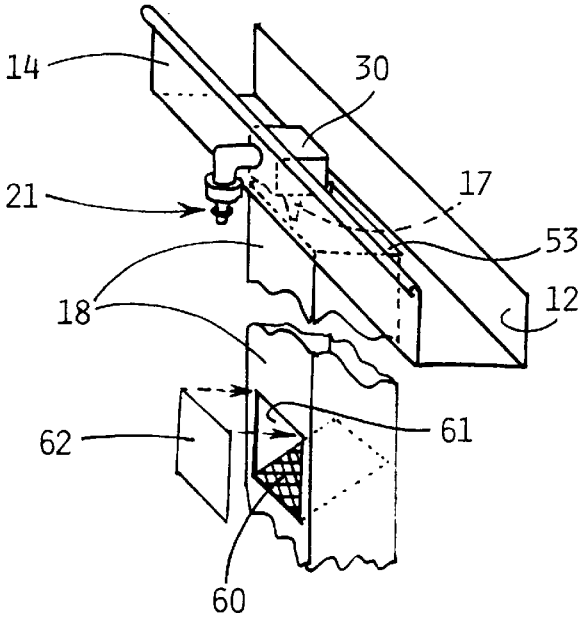

Possible and preferred features of the present invention will now be described with particular reference to the accompanying drawings. However it is to be understood that the features illustrated in and described with reference to the drawings are not to be construed as limiting on the scope of the invention. In the drawings:

FIG. 1 shows a guttering cleaning system according to the present invention, and FIGS. 2, 3 and 4 show some possible variations in design of the water outlets used at different positions in building guttering systems.

In the drawings, the guttering cleaning system 10 is shown mounted to a building structure 11 and in use with guttering 12 which is provided with base wall 13 and outside wall 14. The system includes water outlets 15 in the form of nozzles 17 arranged to direct water in a jet or spray 16 into and along the guttering 12 to flush debris that may have gathered in the guttering.

A releasable water connection 20 comprises an outlet connector 21 at each water outlet 15 and a supply connector 22 for releasable connection to the outlet connectors 21. The outlet connectors 21 are mounted to the guttering 12 or, in an alternative possibility which is not illustrated in the drawings, the outlet connectors 21 and water outlets 15 could be mounted to the building structure 11 adjacent to the guttering 12. The system also includes a water supply line 25 having an outlet end 26 provided with the supply connector 22 and an inlet end 27 to be connected to a water supply (not shown).

In use water passes from the inlet end 27 through the supply line 25 to the outlet end 26, through the supply connector 22 to the outlet connector 21 and thence to the water outlet 15 so that the water 16 directed into the guttering 12 can flush debris from the guttering. The supply connector 22 can be disconnected from the outlet connector 21 and moved to another outlet connector when flushing of the guttering at one location has been completed.

Each water outlet 15 is shown in the form of a water nozzle 17 for directing a jet or spray of water 16 into the guttering preferably in a direction along which water flows towards a discharge downpipe 18 (FIG. 4). The force of the jet or spray of water 16 will depend on the configuration of the nozzle 17 and also on the water pressure and volume of water. However it is possible to provide nozzle configurations operative to blow light debris such as dry leaves from the guttering 12 while heavier debris such as silt can be flushed along the guttering 12 through the downpipe 18.

In the drawings, each water outlet nozzle 17 is provided by a connector block 30 having a passage through which water entering the block from the associated outlet connector 21 passes. In FIG. 2, where there is a straight section of guttering 12 and rain water flows in one direction to a downpipe, the connector block 30 has a nozzle 17 directed in the downstream direction along the guttering 12. As shown in FIG. 3, more than one nozzle 17 may be provided by a connector block 30. In FIG. 3 at an elbow 35 in the Buttering where water in use is intended to flow away the elbow in both directions towards remote downpipes, the connector block 30 has two nozzles 17 directed in both directions along the guttering away from the elbow 35.

As shown in FIG. 1, the connector blocks 30 may be mounted in the base wall 13 of the guttering 12. Preferably the connector blocks 30 have a low profile or contoured profile as seen in FIG. 2 so as not to provide substantial obstruction to flow of rain water. The guttering 12 in FIG. 1 is drilled in its base wall 13 to provide a hole 19 and the mounting block 30 is arranged inside the guttering and the outlet connector 21 is mounted beneath the base wall 13 of the guttering. Water passes through the passage 24 provided in the outlet connector 21, through the hole 19 in the base wall 13 of the guttering 12 and into the passage 31 in the connector block 30. A sealing ring 29 is provided around the hole 19 to prevent leakage of water. The outlet connector 21 and connector block 30 are shown with a screw threaded connection but other connection arrangements are possible.

As an alternative to providing a hole 19 in the base wall 13 of the guttering 12, the outside wall 14 of the guttering 12 may be tapped for mounting of the connector block 30 as shown in FIG. 4. As a further alternative as shown in FIG. 3, the water outlet 15 may be clamped or otherwise mounted to the top edge of the wall 14 so that the outlet connector 21 is accessible from outside of the guttering 12 and the water outlet 15 is directed along the guttering so as to direct the flushing water along the guttering from the top edge of the outside wall 14.

The releasable connection 20 is illustrated as a standard or conventional garden hose connection arrangement. In particular, the outlet connector 21 comprises a male connection having a projection 40 which is coupled in use with a complementary female connection which constitutes the supply connector 22. The supply line 25 constitutes a connection support 45 which enables remote connection and disconnection of the supply connector 22 from the ground adjacent the building structure 11. The connection support 45 comprises a support pole 46 provided with the supply connector 22 at its upper end. The system also includes a connection release means 50 enabling selective release of the connection between the supply connector 22 and the outlet connector 21.

The support pole 46 is a hollow tubular pole and the supply line 25 is constituted by the passage or bore 47 provided through the height of the support pole 46. The pole 46 may be provided in lengths which can be releasably coupled together, e.g. as illustrated at 48, to provide a pole of the required length to reach the outlet connectors 21. The lower end of the support pole 46 is provided with or coupled to a hose 65 having a connector for connection to the water supply. For example the hose 65 may be coupled to a water supply tap or faucet by a releasable connection of conventional construction and operation.

The connection release means 50 comprises a release cord 51 extending along the length of the support pole 46 and coupled to the supply connector 22. The conventional garden hose female connection 41 is provided with a collar 42 which is retracted to release the connection with the male projection 40. Using this kind of connection 20, the connection release cord 51 can extend from the retractable collar 42 so that upon pulling of the cord from the ground level, the collar 42 retracts and disconnects the supply connector 22 from the outlet connector 24. When coupling the supply connector 22 to the outlet connector 21, the support pole 46 is located generally in position and the pole is raised to form a snap fit connection of the female supply connector 41 to the outlet connector male projection 40.

Desirably, the supply line 25 is provided with a water control valve 55 so that the user can connect and disconnect the supply of water as desired. The valve 55 may comprise a simple water supply valve operated by a handle 56 or any other suitable operating mechanism.

As shown in FIG. 4, a screen 60 is mounted within the downpipe 18. The downpipe 18 includes an access hatch 61 in its wall immediately above the screen 60 and which is normally covered by a removable hatch cover 62. The screen 60 traps debris travelling down the downpipe 18 while allowing water to pass through and the hatch cover 62 is removable to enable a user to clear debris trapped by the screen 60.

It will be seen that the system described and illustrated can enable the supply line 25 to be connected to the water supply and the water supply can be turned on at the source. The control valve 55 can be initially closed so that the user can move to the position of the first water outlet 15 and raise the support pole 46 to couple the supply connector 22 to the outlet connector 21. The control valve 55 can then be opened so that water flows through the supply line 25 through the releasable connection 20 and out through the water outlet 15 to flush debris from the guttering 12 in the vicinity of the particular outlet.

The operator can then close the control valve 55 to disconnect the supply of water, and pull on the release cord 51 to uncouple the female supply connector 22 from the outlet connector 21. The operator can then move to the next water outlet 15 and repeat the flushing process.

It will be seen that the system can be relatively simple to install, can use relatively simple manufactured components and can be simple and effective to use.

Variations in the construction and use of the particular system described and illustrated are possible. For example, in addition to the provision of water outlets for directing water into guttering, there may be provided water outlets on the outside of and beneath the guttering for directing water in a spray downwardly along the walls of the building. This can be desirable for washing of building walls and also in localities susceptible to bush fires for enabling drenching of building walls in the event of a bush fire so that the chances of the building surviving the fire can be improved.

In addition to the mounting of water outlets to the guttering to direct water along the guttering to dislodge and flush debris, as shown in FIG. 4 a water outlet 15 may be provided at each downpipe 18 to direct water, particularly a jet of water, downwardly into the mouth 53 of the downpipe. Such a water outlet 15 may be mounted to the top edge of the guttering at the location of the mouth of the downpipe. This water outlet can be supplied with water under pressure to assist flushing of debris that can gather around the mouth of the downpipe 18 and also to direct water with some force through the downpipe to help dislodge any obstructions in the downpipe.

I claim:

1. A guttering cleaning system for cleaning of spouting and guttering in building structures, characterised in that the system includes:

a plurality of water outlets (15) for mounting to or adjacent rain water guttering (12) of a building (11), the water outlets (15) being arranged for directing water into the guttering to flush any debris that has gathered in the guttering;

a releasable water connection (20) comprising a plurality of outlet connectors (21), one outlet connector (21) being provided for each of the water outlets (15) and each outlet connector being able to convey water to the respective associated water outlet (15), the releasable water connection (20) also comprising a supply connector (22) releasably connected to any one of the outlet connectors (21) for supplying water from a water supply to the outlet connectors (21) and for enabling disconnection of the water supply from the outlet connectors, each outlet connector (21) being adapted to be mounted and to remain in place on or adjacent the guttering and in communication with the respective water outlet (15); and a water supply line (25) having two ends, one end (26) of the supply line being provided at the supply connector (22), the other end (27) of the water supply line being arranged for connection to the water supply so that the water can be supplied through the supply line (25) to the supply connector (22) for supplying water through the outlet connector (21) to which the supply connector is connected and thence to the respective water outlet (15) so as to flush any debris in the guttering (12), the supply connector (22) being capable of being released and disconnected from the associated outlet connector (21) and moved to any other one of the outlet connector when flushing of the guttering at one location has been completed.

2. A guttering cleaning system as claimed in claim 1 characterised in that each water outlet (15) comprises a water nozzle (17) for directing a jet or spray of water (16) into the guttering (12), each nozzle being provided by a connector block (30) having a passage extending from the associated outlet connector (21) to the nozzle (17) for water passage from the outlet connector to the nozzle.

3. A guttering cleaning system as claimed in claim 2 characterised in that some of the connector blocks (30) are provided with at least one more nozzle (17) arranged for directing water in respective different directions into the associated guttering (12).

4. A guttering cleaning system as claimed in claim 2 characterised in that each connector block (30) is arranged to be mounted in a base wall (13) of the guttering (12) along which any rain water flows in use, each connector block (30) having a profile designed to minimize obstruction to any flow of rain water past the connector block.

5. The guttering cleaning system as claimed in claim 2 characterised in that the system is for cleaning of guttering (12) provided with a hole (19) in a base wall (13) of the guttering for each of the connector blocks (30), each connector block being able to be mounted inside of the guttering

(12) to the base wall (13) and the associated connector (21) being able to be mounted beneath the base wall (13) of the guttering at the respective hole (19) for water passage through the outlet connector (21) through the hole in the base wall (13) of the guttering (12) and into the connector block (30) and thence to the nozzle (17).

6. A guttering cleaning system as claimed in claim 5 characterised in that the system includes a sealing ring (29) for association with each hole (19) provided in the base wall (13) of the guttering, the sealing ring (29) for preventing leakage of water from the guttering (12) through the hole.

7. A guttering cleaning system as claimed in claim 1 characterised in that the system further includes a connector support (45) for enabling remote connection and disconnection of the supply connector (22) by a user from the ground adjacent a building, the connector support (45) comprising a support pole (46) provided with the supply connector (22) at its upper end, the supply line (25) extending up the support pole (46) to the supply connector (22), the system further including a connection release means (50) enabling selective release of the connection between the supply connector (22) and the respective associated outlet connector (21).

8. A guttering cleaning system as claimed in claim 7 characterised in that the support pole (46) comprises a hollow tubular pole, the supply line (25) comprising a bore (47) provided by the tubular pole (46) so that water is able to enter the support pole at its lower end and travel upwardly through the bore (47) in the tubular pole (46) to the supply connector (22) provided at the upper end.

9. A guttering cleaning system as claimed in claim 7 characterised in that the connection release means (50) comprises a release cord (51) extending along the length of the support pole (46) and coupled to the supply connector (22), pulling of the release cord (51) by a user causing release of the connection between the supply connector (22) and the respective associated outlet connector (21), the connection of the supply connector (22) to a selected one of the outlet connectors (21) being achieved by raising the support pole to cause the supply connector (22) to form a snap fit connection with the selected one of the outlet connectors (21).

10. A guttering cleaning system as claimed in claim 1 characterised in that the system further includes a water control valve (55) which is selectively operable by a user for disconnecting the water supply as desired, the water control valve (55) being provided at the end of the supply line (25) remote from the supply connector (22), whereby the user is able to disconnect the water supply when connecting the supply connector (22) to a selected one of the outlet connectors (21), and is then able to connect the water supply by opening the valve (55) to cause flushing of the guttering (12), and is then able to disconnect the water supply by closing the valve (55) prior to disconnecting the supply connector (22) from the outlet connector (21) at the end of the flushing operation.

11. A guttering cleaning system installed in a building structure having spouting and guttering for collecting and conveying rain water from the building structure, the guttering cleaning system being characterised by:

a plurality of water outlets (15) mounted to or adjacent rain water guttering (12) of the building (11), the water outlets (15) being arranged for directing water into the guttering (12) to flush any debris that has gathered in the guttering;

a releasable water connection (20) comprising a plurality of outlet connectors (21), one outlet connector being provided at each of the water outlets (15) and each outlet connector (21) being able to convey water to the respective associated water outlet (15), the releasable water connection (20) also comprising a supply connector (22) releasably connected to any one of the outlet connectors (21) for supplying water from a water supply to the outlet connectors (21) and for enabling disconnection of the water supply from the outlet connectors, each outlet connector (21) being mounted and remaining in place on or adjacent the guttering (12) and in communication with the respective water outlet (15); and a water supply line (25) having two ends, one end (26) of the supply line being provided at the supply connector (22), the other end (27) of the water supply line being arranged for connection to the water supply so that the water can be supplied through the supply line (25) to the supply connector (22) and through the outlet connector (21) to which the supply connector is connected and thence to the respective water outlet (15) so as to flush any debris in the guttering (12), the supply connector (22) being capable of being released and disconnected from the associated outlet connector (21) and moved to any other one of the outlet connectors (21) when flushing of the guttering (12) at one location has been completed.

12. A guttering cleaning system as claimed in claim 11 characterised in that each water outlet (15) comprises a water nozzle (17) arranged for directing a jet or spray of water (16) into the guttering (12) in a direction along the guttering towards to an associated discharge downpipe (18) provided for conveying water from the guttering (12).

13. A guttering cleaning system as claimed in claim 11 characterised in that each water outlet (15) comprises a water nozzle (17) for directing a jet or spray of water into the guttering (12), each nozzle (17) being provided by a connector block (30) having a passage (31) extending from the associated outlet connector (21) to the nozzle (17) for water passage from the outlet connector (21) to the nozzle (17), each connector block (30) being mounted in a base wall (13) of the guttering (12) along which any rain water flows, each connector block (30) having a profile designed to minimize obstruction to any flow of rain water past the connector block.

14. A guttering cleaning system as claimed in claim 13 characterised in that the guttering is provided with a hole (19) in the base wall (13) of the guttering for each of the connector blocks (30), each connector block being mounted inside of the guttering (12) to the base wall (13) and the associated outlet connector (21) being mounted beneath the base wall (13) of the guttering at the respective hole (19) for water passage through the outlet connector (21), through the hole (19) in the base wall (13) of the guttering (12) and into the connector block and (30) thence to the nozzle (17).

15. A guttering cleaning system as claimed in claim 13 characterised in that at least one of the water outlets (15) is mounted adjacent the top edge of an outside wall of the guttering (12) and the associated outlet connector (21) is accessible from below and outside of the outside wall of the guttering, the water outlet (15) being directed along the guttering (12) for directing water along the guttering from the top edge of the outside wall.

16. A guttering cleaning system as claimed in claim 11 characterised in that the system includes a downpipe (18) having a mouth (53) opening into a base wall (13) of the guttering (12), and further characterised in that at least one of the water outlets (15) is mounted to the guttering (12) and is arranged for directing water downwardly into the mouth (53) of the downpipe (18) provided for conveying water downwardly from the base wall (13) of the guttering (12), thereby the water outlet (15) able to supply water for assisting flushing of any debris that can gathers around the mouth (53) of the downpipe (18) and for directing water with some force through the downpipe to help to dislodge any obstructions in the downpipe.

17. A guttering cleaning system as claimed in claim 1 characterised in that there is provided a screen (60) within a downpipe (18) which is able to convey water downwardly from the guttering (12), the downpipe (18) including an access hatch (61) located in a wall of the downpipe immediately above the screen and which is normally covered by a removable hatch cover (62), the screen (60) operating to trap any debris travelling down the downpipe while allowing water to pass through and the hatch cover (62) being removable to enable a user to clear debris trapped by the screen (60).

18. A guttering cleaning system as claimed in claim 11 further characterised by a connector support (45) for enabling remote connection and disconnection of the supply connector (22) by a user from the ground adjacent the building, the connector support (45) comprising a support pole (46) having an upper end and provided with the supply connector (22) at the upper end, the supply line (25) extending up the support pole (46) to the supply connector (22), the system further including a connection release means (50) enabling selective release of the connection between the supply connector (22) and the respective associated outlet connector (21).

19. A guttering cleaning system as claimed in claim 18 characterised in that the support pole (46) comprises a hollow tubular pole, the supply line (25) comprising a bore (47) provided by the tubular pole (46) so that water is able to enter the support pole at its lower end and travel upwardly through the bore (47) in the tubular pole (46) to the supply connector (22) provided at the upper end.

20. A guttering cleaning system as claimed in claim 18 characterised in that the connection release means (50) comprises a release cord (51) extending along the length of the support pole (46) and coupled to the supply connector (22), pulling of the release cord (51) by a user causing release of the connection between the supply connector (22) and the respective associated outlet connector (21), the connection of the supply connector (22) to a selected one of the outlet connectors (21) being achieved by raising the support pole to cause the supply connector (22) to form a snap fit connection with the selected one of the outlet connectors (21).

21. A guttering cleaning system installed in a building structure having spouting and guttering for collecting and conveying rain water from the building structure, the guttering cleaning system being characterised by:

a plurality of water outlets (15) mounted to or mounted adjacent rain water guttering (12) of the building (11), the water outlets (15) being arranged for directing water into the guttering (12) to flush any debris that has gathered in the guttering;

a water supply line (25) in communication with one or more of the water outlets (15) and also being connected to a the water supply so that the water can be supplied through the supply line (25) to the respective water outlets (15) so as to flush any debris in the guttering (12);

a water control valve (55) which is selectively operable by a user to disconnect the water supply as desired, the water control valve (55) being provided in the supply line (25) whereby the user can selectively connect the water supply by opening the valve (55) to cause flushing of the guttering (12), and can then disconnect the water supply by closing the valve (55), wherein each water outlet (15) comprises a water nozzle (17) for directing a jet or spray of water into the Buttering (12), each nozzle (17) being provided by a connector block (30) having a passage (31) receiving water from the supply line and through which water passes to the nozzle (17), each connector block (30) being mounted in a base wall (13) of the guttering (12) along which any rain water flows, each connector block (30) having a profile designed to minimize obstruction to any flow of rain water past the connector block.

22. A guttering cleaning system as claimed in claim 21 characterised in that each water nozzle (17) is arranged so as to direct a jet or spray of water (16) into the guttering (12) in a direction along the guttering towards an associated discharge downpipe (18) provided for conveying water from the guttering (12).

23. A guttering cleaning system as claimed in claim 21 characterised in that at least one of the water outlets (15) is mounted to the guttering (12) and is arranged for directing water downwardly into the mouth (53) of a downpipe (18) provided for conveying water downwardly from the base wall (13) of the guttering (12), the water from the water outlet (15) thereby assisting flushing of any debris that can gather around the mouth (53) of the downpipe (18) and to direct water with some force through the downpipe to help to dislodge any obstructions in the downpipe.

24. A guttering cleaning system as claimed in claim 21 characterised in that there is provided a screen (60) within a downpipe (18) which is able to convey water downwardly from the guttering (12), the downpipe (18) including an access hatch (61) located in a wall of the downpipe immediately above the screen and which is normally covered by a removable hatch cover (62), the screen (60) operating to trap any debris travelling down the downpipe while allowing water to pass through and the hatch cover (62) being removable to enable a user to clear debris trapped by the screen (60).

* * * * *